US008069636B1

(12) United States Patent
Gutentag

(10) Patent No.: US 8,069,636 B1
(45) Date of Patent: Dec. 6, 2011

(54) METHOD AND APPARATUS TO FACILITATE RETENTION AND REMOVAL OF COMPONENTS PLACED ON ADHESIVE BACKED CARRIER TAPE FOR AUTOMATED HANDLING

(76) Inventor: Charles Gutentag, Los Angeles, CA (US)

( * ) Notice: Subject to any disclaimer, the term of this patent is extended or adjusted under 35 U.S.C. 154(b) by 0 days.

(21) Appl. No.: 12/074,764

(22) Filed: Mar. 5, 2008

(51) Int. Cl.
*B65B 1/04* (2006.01)

(52) U.S. Cl. ..... 53/473; 53/452; 53/167

(58) Field of Classification Search ..... 53/473, 53/452, 475, 558, 167; 206/714, 813, 460, 206/715
See application file for complete search history.

(56) References Cited

U.S. PATENT DOCUMENTS

| | | | | | |
|---|---|---|---|---|---|
| 3,313,084 | A * | 4/1967 | Forman | 53/428 |
| 3,700,089 | A * | 10/1972 | Halbartschlager et al. | 198/449 |
| 3,756,399 | A * | 9/1973 | Cosier et al. | 206/497 |
| 4,406,367 | A * | 9/1983 | Bouwknegt | 206/714 |
| 4,702,788 | A * | 10/1987 | Okui | 156/252 |
| 4,966,281 | A * | 10/1990 | Kawanishi et al. | 206/714 |
| 5,033,615 | A * | 7/1991 | Shima et al. | 206/714 |
| 5,203,143 | A * | 4/1993 | Gutentag | 53/452 |
| 5,234,105 | A * | 8/1993 | Sato et al. | 206/706 |
| 5,648,136 | A * | 7/1997 | Bird | 428/76 |
| 7,097,040 | B1 * | 8/2006 | Gutentag | 206/714 |

* cited by examiner

*Primary Examiner* — Sameh H. Tawfik
(74) *Attorney, Agent, or Firm* — Thomas I. Rozsa

(57) ABSTRACT

An improved adhesive-backed carrier tape system for packaging of components. Components or devices are held within the compartments of the carrier portion by a low tack adhesive level layer while a high tack adhesive layer is affixed to the carrier portion to provide means for high speed, low cost automated handling of the packaged components.

8 Claims, 5 Drawing Sheets

FIG. 1A
Prior Art
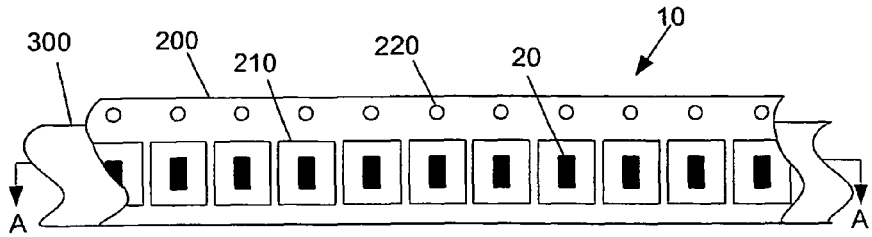
FIG. 1B
Prior Art
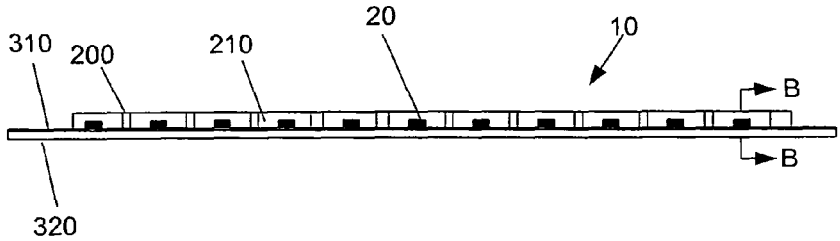
FIG. 1C
Prior Art
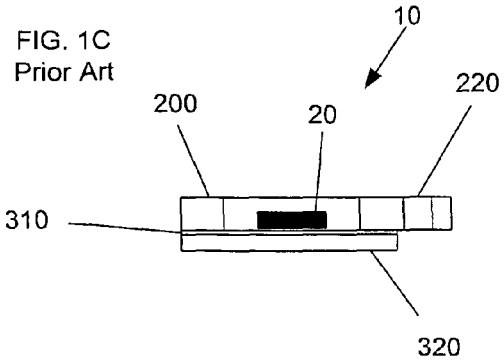
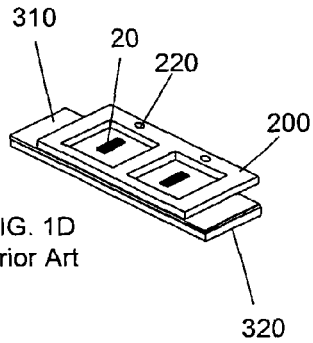
FIG. 1D
Prior Art

METHOD AND APPARATUS TO FACILITATE RETENTION AND REMOVAL OF COMPONENTS PLACED ON ADHESIVE BACKED CARRIER TAPE FOR AUTOMATED HANDLING

FIELD OF THE INVENTION

This invention relates to the field of packaging systems for automated component handling. Specifically, the present invention relates to carrier tape packaging systems utilizing pressure sensitive adhesive (PSA) tape for component retention. More particularly, the present invention incorporates unique ways to securely retain components, yet enable their ready release and retrieval using conventional tape feeders and component pick tools.

DESCRIPTION OF THE PRIOR ART

One of the manners in which components may be supplied to a typical printed circuit board machine is on adhesive backed carrier tape (as shown in FIGS. 1A-1D) supplied through a component feeder. Adhesive backed carrier tape 10 typically comprises a carrier portion 200 and an adhesive tape 300. The carrier portion 200 may further comprise a plurality of compartments or pockets 210 of maximum practical size consistent with each industry standard carrier tape width, pierced through continuous lengths of carrier tape material (typically plastic). In addition carrier portion 200 may further comprise a plurality of sprocket drive holes 220, repeatably positioned along at least one side of carrier portion 200. Holes 220 may interact with sprocket wheels or pawls within the component feeder to aid in forwarding, or indexing of carrier tape 10 within the feeder. Adhesive tape 300 typically comprises a pressure sensitive adhesive layer 310 applied to base portion 320. The adhesive tape 300 may be laminated to the reverse (i.e. bottom) side of the carrier portion 200. The compartments 210 within carrier portion 200 provide access to exposed areas of the adhesive tape 300 upon which components may be placed on the adhesive layer 310 of adhesive tape 300. The tack level of adhesive layer 310 must be very aggressive to ensure that adhesive tape 300 will remain securely attached to carrier portion 200 during automated handling without delaminating from carrier portion 200. However, this aggressive adhesive tack level is such that it prevents rapid, unassisted separation of components (especially very small components) from the adhesive layer, using commercially available pick tools for component retrieval and placement by automated pick and place assembly machines.

When the adhesion-to-component bond is such that the component pick tool is unable to remove components from the adhesive tape 300, a lift pin or other feeder enabler may be incorporated into the tape feeder. The lift pin assists the vacuum pick tool in removing each component from the high tack adhesive backing. Such feeders with a lift pin are very costly when compared to feeders for conventional punched or embossed pocket carrier tapes. In addition, these feeders must be custom fitted to each pick and place machine platform and integrated with the host computer in order to function successfully. Cost and limited availability of these special feeders has restricted widespread use and acceptance of traditional adhesive backed carrier tape to a limited number of high volume production applications.

In an effort to overcome the need for feeders with a lift pin, an attempt was made to use a silicon gel in lieu of adhesive tape 300 to provide an adhesive surface beneath the compartments 210 within continuous carrier 200. However, it was determined that the use of a gel required incorporation of a vacuum plenum within the carrier tape feeder to successively draw down the gel beneath each compartment at the pick point to release the component-to-gel cohesive bond. Again like the lift pin, inclusion of a vacuum plenum into a feeder added even greater cost and complexity than a lift pin.

In yet another attempt, a UV sensitive PSA tape was employed in place of adhesive tape 300. In this instance the compartment portion of the tape was exposed to UV radiation to reduce the adhesion tack level of the tape within the compartment portion only. Whereas this effort eliminated the necessity of adding a lift pin or a vacuum plenum to the feeder, the ability to precisely control reduction of adhesive tack level of the UV sensitive tape portion beneath each compartment proved to be impractical.

Therefore, the need exists for improved adhesive backed carrier tapes which will not delaminate during automated handling and will eliminate the need for an auxiliary means to assist in removing components from adhesive backed carrier tape compartments and enable unaided pickup by conventional pick tools used on automated pick and place assembly machines. There is a further need to provide predefined and consistent low levels of adhesion beneath each compartment to customize the component-to-tape bonding strength for a full range of component and device types of various sizes and weights suitable for automated assembly to ensure rapid consistent pickup and placement thereof by conventional pick tools.

There is a significant need for an improved method and apparatus to retain components on an adhesive backed carrier tape which overcomes the problems encountered with conventional punched and embossed pocket carrier tapes and related apparatus.

SUMMARY OF THE INVENTION

The present invention provides a carrier tape system for packaging components that is easily constructed, does not require the use of auxiliary means to release the components from the system, and is lower in cost.

In a first general aspect, the present invention provides a carrier tape system, for supplying components to a pick and place assembly machine through a feeder, comprising a carrier portion, having multiple compartments formed therein, at least one low tack adhesive layer, and at least one high tack adhesive layer, wherein the at least one low tack adhesive layer is positioned to retain components placed in the compartments and the at least one high tack adhesive layer is positioned to be affixed to the carrier portion.

In a second general aspect, the present invention provides a method of packaging components for automated handling, comprising providing a carrier portion with compartments therein, providing at least one base portion, providing at least one high tack adhesive layer, and providing at least one low tack adhesive layer, wherein at the least one high tack adhesive layer and the at least one low tack adhesive layer are positioned between the carrier portion and the base portion, such the at least one high tack adhesive layer is affixed to the carrier portion and the at least one low tack adhesive layer is positioned to retain the components placed within the compartments of the carrier portion.

BRIEF DESCRIPTION OF THE DRAWINGS

Referring particularly to the drawings for the purpose of illustration only and not limitation, there is illustrated:

FIG. 1A illustrates a top view of a carrier tape system of the prior art;

FIG. 1B illustrates a cross section view taken along line A-A of FIG. 1A;

FIG. 1C illustrates a cross section view taken along line B-B of FIG. 1B;

FIG. 1D illustrates a perspective view of a carrier tape system of FIG. 1A of the prior art.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the claims to be appended to one or more applications for use based upon the technology set forth herein.

The present invention improves the prior art carrier tape system, by utilizing a composite pressure sensitive adhesive (PSA) tape having various levels of adhesion to achieve a combination of both high and low tack pressure sensitive characteristics. The composite PSA tape may collectively provide two different levels of adhesion: 1) a high tack adhesion level to ensure secure bonding to the carrier portion without delaminating during use; and 2) a low tack adhesion level to which the components or devices are to be attached.

In this context, the word "low" is defined as that which is sufficient to retain the components or devices in position during automated handling, yet will allow removal by automated conventional pick tool means, without the need for auxiliary mechanical assistance. Creating such variations in the adhesion level on a single tape is both challenging and costly. For optimum performance the low tack adhesion level used for component retention may be selected from in a range of adhesion tack levels based upon the size, weight and configuration characteristics of the components to be held in position. The characteristics of the aforesaid composite PSA tape may be readily accomplished by laminating two or more PSA tapes together in one continuous band, such that the high and low PSA tapes are correctly positioned when the composite tape is affixed to the carrier portion.

The means thus described represent the unique feature of this invention, where two widely varied levels of adhesion are achieved within a single continuous length of a composite PSA tape.

Figure 2A:
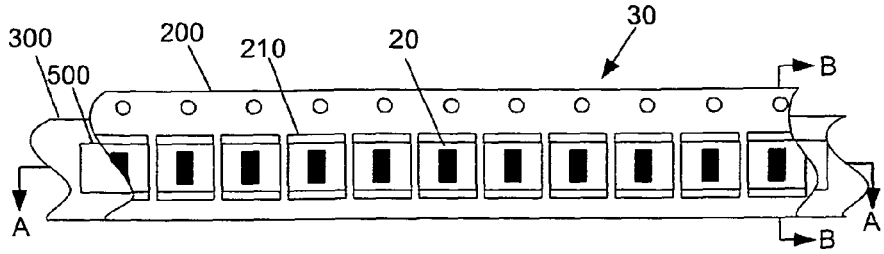
FIG. 2A illustrates a top view of a carrier tape system in accordance with embodiments of the present invention.
Figure 2B:
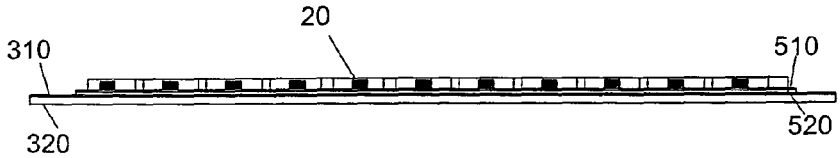
FIG. 2B is a cross section view taken along line A-A of FIG. 2A.
Figure 2C:
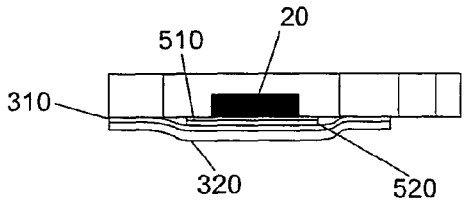
FIG. 2C is a cross section view taken along line B-B of FIG. 2A.

FIGS. 2A-2C illustrate carrier tape system 30, in accordance with embodiments of the present invention. Carrier tape system 30 comprises a continuous carrier portion 200, a continuous high tack PSA tape 300, and a continuous low tack PSA tape 500. The PSA tapes 300, 500 each have an adhesive layer 310, 510 applied to the base portion 320, 520. The low tack PSA tape 500 is positioned on top of high tack PSA tape 300, creating a composite PSA tape, such that the outer edges of high tack PSA tape 300 are affixed to the bottom surface of the carrier portion 200 while the low tack PSA tape 500 is positioned to retain the components 20 placed in compartments 210 of carrier portion 200. The unique feature of the present invention is to provide an adhesive level within each compartment of the carrier tape, where such adhesive tack level is sufficient to retain components 20 but is low enough to enable the component to be removed by commercially available pick tools and does not require the further assistance of a feeder function or other auxiliary means to assist in releasing the components from the carrier tape adhesive.

The total solution to the problems aforesaid is achieved by providing calibrated low tack adhesion levels on PSA tape 500 which will suffice to retain components securely in position during handling, yet enable ready release without the need for lift pin, vacuum or other auxiliary assistance means. Depending upon component size, mass, surface finish and other physical characteristics, requisite adhesive tack levels for the low tack adhesive could range upwards from less than 0.01 Newton per square millimeter of adhesive-to-device bond area. The optimum level of pull force adhesion may range from 0.01 Newton to 0.1 Newton per square millimeter of adhesive-to-device bond area. The high tack adhesive level should be at least 30 ounces per inch peel force as determined by applicable ASTM standards.

Alternatively, the carrier tape system 30 of FIGS. 2A-2C, may be described as comprising a continuous carrier portion 200, a continuous high tack adhesive layer 310, a continuous low tack adhesive layer tape 510 and continuous base portions 320, 520. The carrier tape system 30 maybe assembled by applying the low tack adhesive layer 510 to carrier portion 200, such that the low tack adhesive layer is within the compartments 210 of carrier portion 200. Next base portion 520 is applied to the low tack adhesive layer 510. The high tack adhesive layer is then applied to the base portion 520 and carrier portion 200. Finally, the base portion 520 is applied to the high tack adhesive layer 310. Thus the low tack adhesive layer 510 is layered between carrier portion 200 and high tack adhesive layer 310 such that the low tack adhesive layer is positioned to retain the components 20 placed in compartments 210 of carrier portion 200 and the high tack adhesive layer may be affixed to the carrier portion 200 so that the carrier system 30 will not separate or delaminate during handling. This same principal of layering as opposed to individual or composite tapes may be applied to the various carrier systems described below.

Figure 3A:
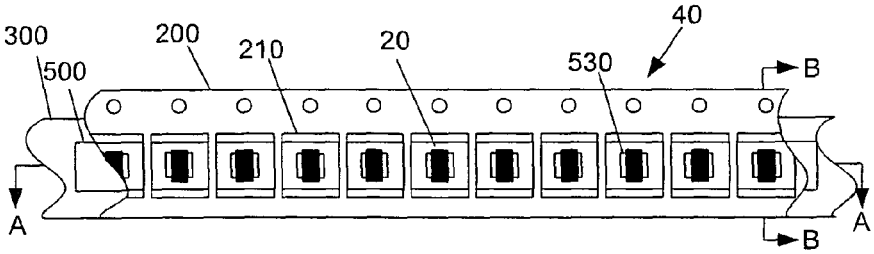
FIG. 3A illustrates a first variation of the carrier tape system of FIG. 2A in accordance with embodiments of the present invention.
Figure 3B:
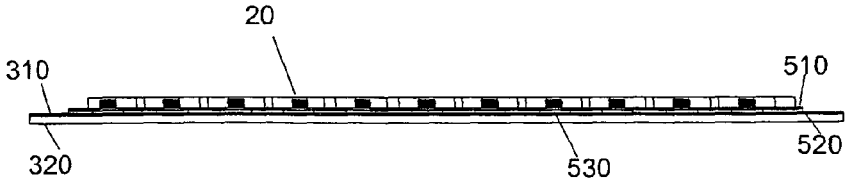
FIG. 3B is a cross section view taken along line A-A of FIG. 3A.
Figure 3C:
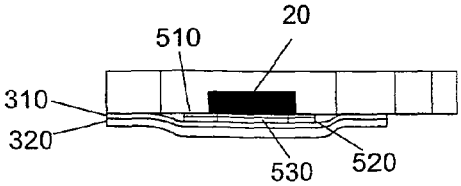
FIG. 3C is a cross section view taken along line B-B of FIG. 3A.

FIGS. 3A-3C illustrate a variation carrier tape system 30 of FIG. 2A showing carrier tape system 40, in accordance with embodiments of the present invention. In this embodiment low tack PSA tape 500 of carrier tape system 40 further includes holes 530. Holes 530 further reduce the adhesive-to-component bonding area beneath the compartment 210 to which the component 20 is affixed. In similar fashion the low tack adhesive bonding area to which components will be affixed, can be perforated with a pattern of holes (not shown) of equal or unequal size and shape to remove a calibrated total area of adhesive material to which components 20 would otherwise be affixed.

Figure 4A:
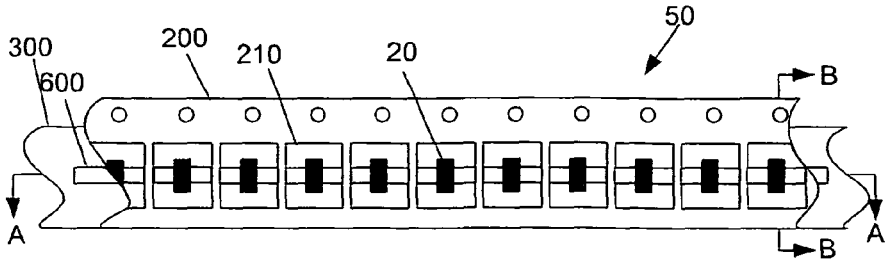
FIG. 4A illustrates a variation of the carrier tape system of FIG. 2A in accordance with embodiments of the present invention.
Figure 4B:
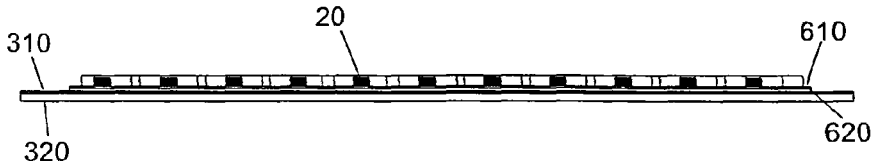
FIG. 4B is a cross section view taken along line A-A of FIG. 4A.
Figure 4C:
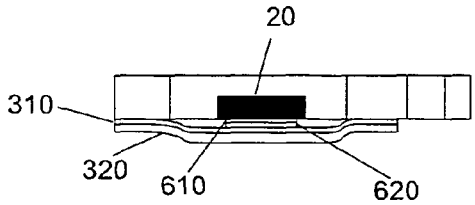
FIG. 4C is a cross section view taken along line B-B of FIG. 4A.

FIGS. 4A-4C illustrate a variation carrier tape system 30 of FIG. 2A showing carrier tape system 50, in accordance with embodiments of the present invention. Carrier tape system 50 comprises a continuous carrier portion 200, a continuous high tack adhesive PSA tape 300, and a continuous low tack adhesive PSA tape 600. The PSA tapes 300, 600 each have an adhesive layer 310, 610 applied to the base portion 320, 620. The low tack PSA tape 600 is positioned on top of high tack PSA tape 300, creating a composite PSA tape, such that the outer edges of high tack PSA tape 300 are affixed to the bottom surface of the carrier portion 200 while the low tack PSA tape 600 is positioned beneath the compartments 210 of carrier portion 200. In this embodiment low tack PSA tape 600 is narrower than components 20 to further reduce the adhesive-to-component bonding area beneath the compartment 210 to which the component 20 is affixed. As illustrated in FIG. 4C, the low tack adhesive layer 610 and its base 620 has a given thickness to thereby prevent the component 20 from coming in contact with the high tack adhesive layer 310.

Figure 5A:
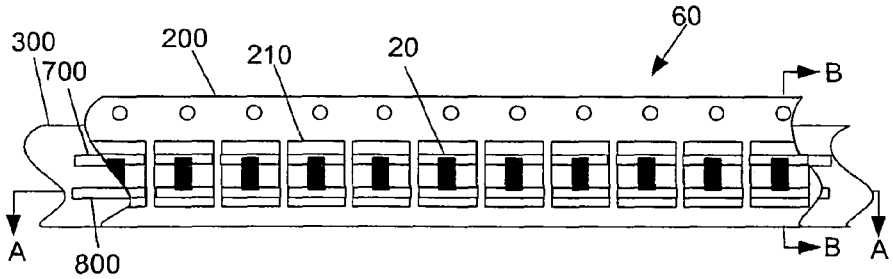
FIG. 5A illustrates a variation of the carrier tape system of FIG. 2A in accordance with embodiments of the present invention.
Figure 5B:
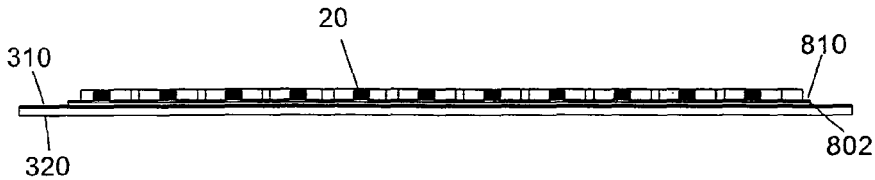
FIG. 5B is a cross section view taken along line A-A of FIG. 5A.
Figure 5C:
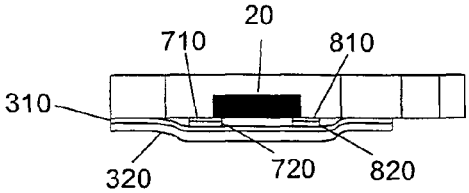
FIG. 5C is a cross section view taken along line B-B of FIG. 5A.

FIGS. 5A-5C illustrate a variation carrier tape system 30 of FIG. 2A showing carrier tape system 60, in accordance with embodiments of the present invention. Carrier tape system 60 comprises a continuous carrier portion 200, a continuous high tack adhesive PSA tape 300, and a one or more continuous low tack adhesive PSA tapes 700, 800. In this embodiment, two narrow low tack PSA tapes 700, 800 are affixed to the top of high tack PSA tape 300 to create a composite PSA tape. PSA tapes 700, 800 both comprise adhesive layers 710, 810 applied to base portions 720, 820. The low tack PSA tapes 700,800 are spaced such that only the outer portions of component 20 are contact low tack PSA tapes 700, 800 thereby reducing the adhesive bonding area beneath the compartment 210 to which the component 20 is affixed. As illustrated in FIG. 5C, the low tack adhesive layers 710 and 810 are aligned with the bottom level of the compartment 210 and the low tack adhesive layers 710 and 810 and their base portions 720 and 820 have a given thickness to thereby prevent the component 20 from coming in contact with the high tack adhesive layer 310.

Figure 6A:
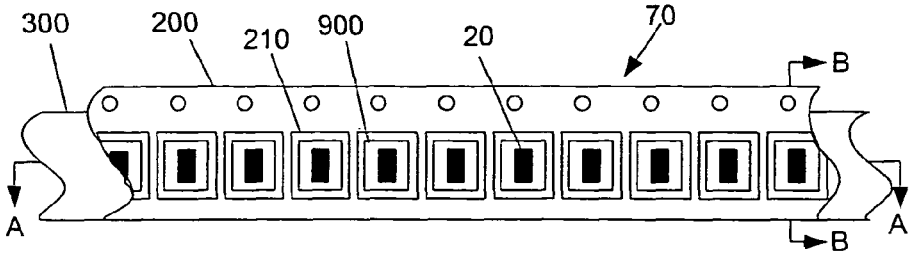
FIG. 6A illustrates a variation of the carrier tape system of FIG. 2A in accordance with embodiments of the present invention.
Figure 6B:
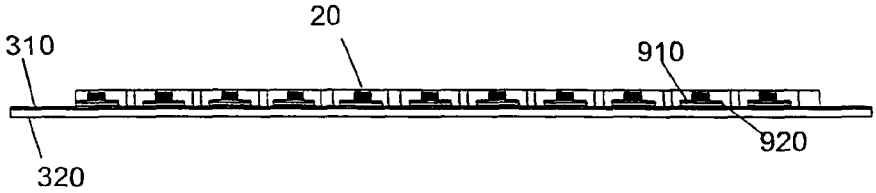
FIG. 6B is a cross section view taken along line A-A of FIG. 6A.
Figure 6C:
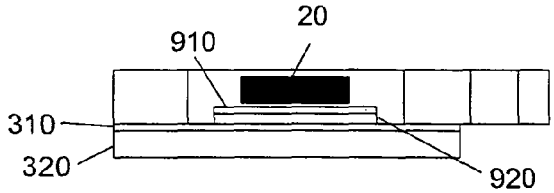
FIG. 6C is a cross section view taken along line B-B of FIG. 6A.

FIGS. 6A-6C illustrate a variation carrier tape system 30 of FIG. 2A showing carrier tape system 70, in accordance with embodiments of the present invention. Carrier tape system 70 comprises a continuous carrier portion 200, a continuous high adhesive PSA tape 300, and a low tack adhesive PSA tape sections 900. The PSA tape 300 and PSA tape sections 900 each have an adhesive layer 310, 910 applied to the base portion 320, 920. The low tack adhesive PSA tape sections 900 are positioned on top of high tack PSA tape 300, creating a composite PSA tape, such that the outer edges of high tack PSA tape 300 are affixed to the bottom surface of the carrier portion 200 while the low tack PSA tape 900 is positioned beneath the compartments 210 of carrier portion 200. In this embodiment sections of low tack PSA tape sections 900, comprising adhesive layer 910 applied to base portion 920, of carrier tape system 70 are applied to the top of high tack PSA tape 300 such that the section of low tack PSA tape sections 900 are positioned only beneath compartments 210 of carrier portion 200. As illustrated in FIG. 6C, the high tack adhesive 310 also is level with the bottom of the compartment 210 and the low tack adhesive layer 910 and its base 920 both rest within the compartment 210 and their given thickness prevents the component 20 from coming in contact with the high tack adhesive 310.

Figure 7A:
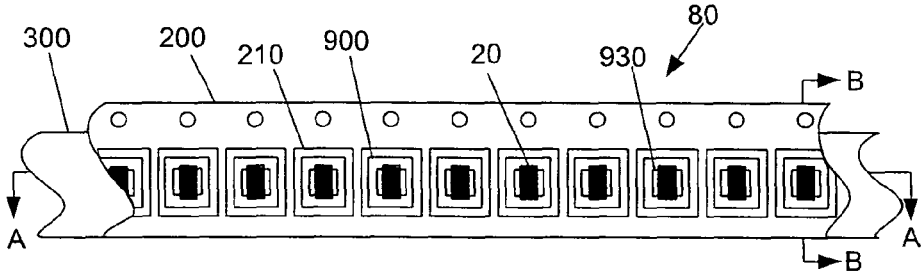
FIG. 7A illustrates a variation of the carrier tape system of FIG. 6A in accordance with embodiments of the present invention.
Figure 7B:
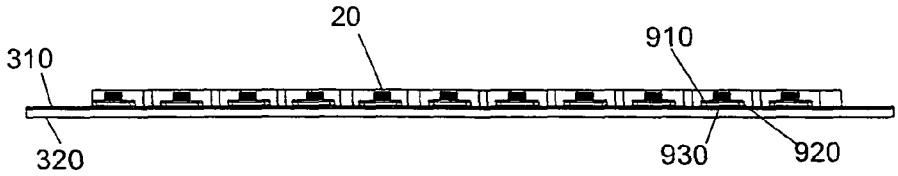
FIG. 7B is a cross section view taken along line A-A of FIG. 7A.
Figure 7C:
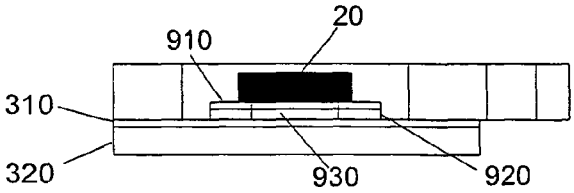
FIG. 7C is a cross section view taken along line B-B of FIG. 7A.

FIGS. 7A-7C illustrate a variation carrier tape system 70 of FIG. 6A showing carrier tape system 80, in accordance with embodiments of the present invention. In this embodiment, sections of low tack PSA tape 900 of carrier tape system 80 further include holes 930. Holes 930 further reduce the adhesive bonding area beneath the compartment 210 to which the component 20 is affixed. In similar fashion the low tack adhesive bonding area to which components will be affixed, can be perforated with a pattern of holes (not shown) of equal or unequal size and shape to remove a calibrated total area of adhesive material to which components 20 would otherwise be attached. As illustrated in FIG. 7C, once again, the high tack adhesive 310 is level with the bottom of the compartment 210 and the low tack adhesive 910 and its base 920 rest within the compartment. The hole 930 further serves to reduce the amount of low tack adhesive 910 which comes in contact with component 20 and the thickness of the low tack adhesive 910 and its base 920 prevent the component 20 from coming in contact with the high tack adhesive layer 310.

Figure 8A:
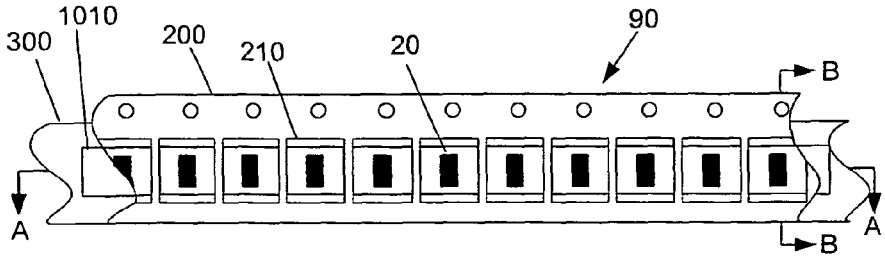
FIG. 8A illustrates a variation of the carrier tape system of FIG. 2A in accordance with embodiments of the present invention.
Figure 8B:
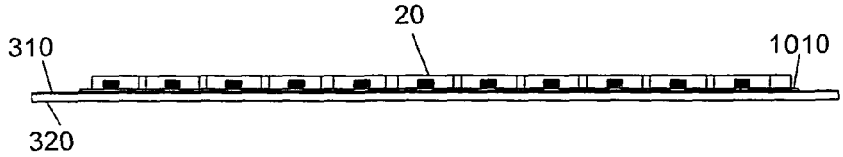
FIG. 8B is a cross section view taken along line A-A of FIG. 8A.
Figure 8C:
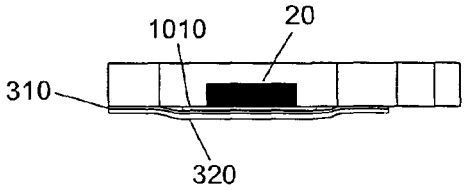
FIG. 8C is a cross section view taken along line B-B of FIG. 8A.

FIGS. 8A-8C illustrate a variation carrier tape system 30 of FIG. 2A showing carrier tape system 90, in accordance with embodiments of the present invention. Carrier tape system 90 comprises a continuous carrier portion 200, a continuous high tack adhesive PSA tape 300, and a continuous low tack adhesive layer 1010. PSA tape 300 has an adhesive layer 310 applied to the base portion 320. In this embodiment, only a low tack adhesive PSA layer 1010 is positioned on top of high tack PSA tape 300, creating a composite PSA tape, such that the outer edges of high tack PSA tape 300 are affixed to the bottom surface of the carrier portion 200 while the low tack PSA layer 1010 is positioned beneath and within the boundaries of the compartments 210 of carrier portion 200. There is no base potion for the low tack adhesive. Removal of the base portion reduces the thickness that the low tack PSA tapes above introduce to the various carrier tape systems described above. As such, this same means may be applied to carrier tapes systems 40, 50, 60, 70, and 80. As illustrated in FIG. 8C, the low tack adhesive 1010 is aligned with the bottom level of the compartment 210 and is of sufficient thickness and covers the surface area of the component 20 so that the component 20 will not come in contact with the high tack adhesive 310.

Figure 9A:
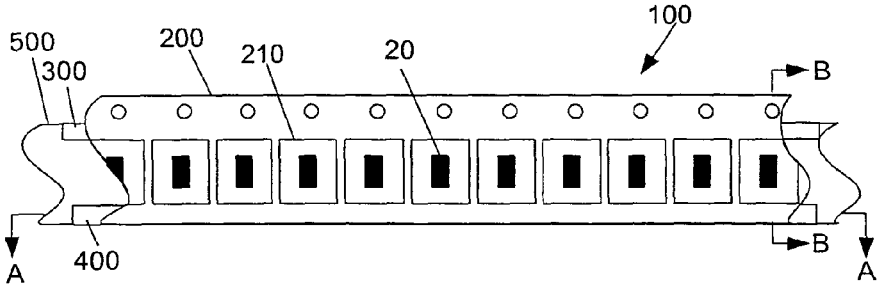
FIG. 9A illustrates a variation of the carrier tape system of FIG. 2A in accordance with embodiments of the present invention.
Figure 9B:
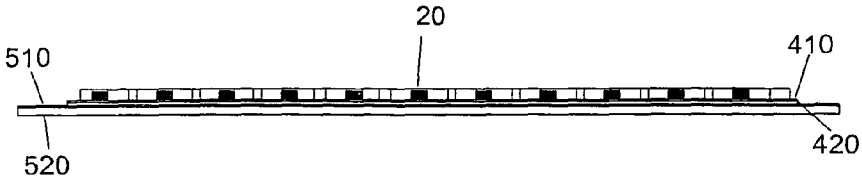
FIG. 9B is a cross section view taken along line A-A of FIG. 8A.
Figure 9C:
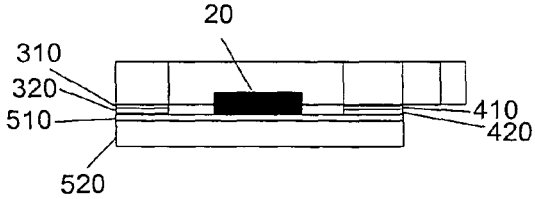
FIG. 9C is a cross section view taken along line B-B of FIG. 8A.

FIGS. 9A-9C illustrate a variation carrier tape system 30 of FIG. 2A showing carrier tape system 100, in accordance with embodiments of the present invention. Carrier tape system 100 comprises a continuous carrier portion 200, a continuous low tack adhesive PSA tape 500, and continuous high tack adhesive PSA tapes 300, 400. The PSA tapes 300, 400, 500 each have an adhesive layer 310, 410, 510 applied to the base portion 320, 420, 520. In this embodiment the layering of the adhesive tapes are reversed, the high tack adhesive PSA tapes 300, 400 are positioned on top of low tack PSA tape 500, creating a composite PSA tape, such that the high tack PSA tapes 300, 400 are affixed to the bottom surface of the carrier portion 200 while the low tack PSA tape 500 beneath high tack PSA tapes 300, 400 as well as positioned to retain the components 20 placed within compartments 210 of carrier portion 200. As illustrated in FIG. 9C, the low tack adhesive level 510 rests below the bottom of the compartment 210 and the component 20 in fact also is partially below the bottom level of the compartment 210.

The key feature of the present invention is obtaining and maintaining two widely different levels of adhesion at defined locations throughout the carrier tape systems described above. The result maintains the high tack adhesive level required to adhere to the carrier portion while providing a low tack adhesion level within each compartment, sufficient only to retain each component in position as placed during automated handling and allow pickup by conventional pick and place machine tools and feeders, without the need for auxiliary mechanical means to release the component from the carrier tape adhesive.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention shall be limited only to the scope of the claims set forth herein. While a dual laminated tape comprising high tack adhesion and low tack adhesion has been described, other alternative means and methods can be employed to achieve a functionally comparable alternative.

Defined in detail, the present invention is a carrier tape system, for supplying components to a pick and place assembly machine through a feeder, comprising: (a) a carrier portion having multiple compartments formed therein; (b) at least one low tack adhesive layer; at least one high tack adhesive layer; and the at least one low tack adhesive layer positioned to retain components respectively placed in the compartments and the at least one high tack adhesive layer affixed to the carrier portion and positioned to secure the low tack adhesive layer to the carrier.

Defined broadly, the present invention is a method of packaging component for automated handling, comprising: (a) providing a carrier portion having multiple compartments formed therein; (b) providing at least one low tack adhesive layer; (c) providing at least one high tack adhesive layer; and (d) the at least one low tack adhesive layer positioned to retain components respectively placed in the compartments and the at least one high tack adhesive layer affixed to the carrier portion and positioned to secure the low tack adhesive layer to the carrier.

What is claimed is:

1. A carrier tape system for supplying components to a pick and place assembly machine through a feeder, comprising:

a. a carrier tape portion having a first surface which is an upper surface and a parallel spaced apart second surface which is a lower surface separated by a given thickness, the carrier tape portion having multiple compartments formed therein between the first and second, surface, each of the multiple compartments having openings including a first opening extending to and aligned with the first surface and a second opening extending to and aligned with the second surface, the respective openings aligned with the first surface permitting access to each respective compartment by the pick and place machine, the respective openings aligned with the second surface enabling an adhesive to retain a respective component;

b. at least one low tack adhesive layer;

c. at least one high tack adhesive layer; and d. the at least one low tack adhesive layer positioned adjacent the second surface so that it is beneath the carrier tape and aligned with the multiple compartments to retain components respectively placed in the compartments and the at least one high tack adhesive layer affixed to the second surface of the carrier tape portion and positioned to secure the low tack adhesive layer to the carrier tape portion.

2. The carrier tape system of claim 1 further comprising:

a. the at least one low tack adhesive layer is applied to the second surface to form a low tack tape;

b. the at least one high tack adhesive layer is applied to the second surface to form a high tack tape; and c. the low tack tape is positioned on top of the high tack tape to create a composite tape, the high tack tape having a greater width than the low tack tape such that the high tack is affixed to the second surface of the carrier portion and the low tack tape is aligned with the compartments.

3. The carrier tape system of claim 2 wherein the low tack tape is aligned with the compartments and the low tack tape has sufficient thickness to prevent the components which rest on the low tack adhesive layer to come into contact with the at least one high tack adhesive layer of the high tack tape.

4. The carrier tape system of claim 2 wherein at least one opening is placed into the low tack tape at a location where a component rests on the adhesive layer of the low tack tape to further reduce the adhesion of the component to the low tack adhesive layer.

5. A method of packaging components for automated handling, comprising:

a. providing a carrier tape portion having a first surface which is an upper surface and a parallel spaced apart second surface which is a lower surface separated by a given thickness, the carrier tape portion having multiple compartments formed therein between the first and second, surface, each of the multiple compartments having openings including a first opening extending to and aligned with the first surface and a second opening extending to and aligned with the second surface, the respective openings aligned with the first surface permitting access to each respective compartment by the pick and place machine, the respective openings aligned with the second surface enabling an adhesive to retain a respective component;

b. providing at least one low tack adhesive layer;

c. providing at least one high tack adhesive layer; and d. the at least one low tack adhesive layer positioned adjacent the second surface so that it is beneath the carrier tape and aligned with the multiple compartments to retain components respectively placed in the compartments and the at least one high tack adhesive layer affixed to the second surface of the carrier tape portion and positioned to secure the low tack adhesive layer to the carrier tape portion.

6. The method of claim 5 further comprising:

a. applying the at least one low tack adhesive layer to the second surface to form a low tack tape;

b. applying the at least one high tack adhesive layer to the second surface to form a high tack tape; and c. positioning the low tack tape on top of the high tack tape to create a composite tape, the high tack tape having a greater width than the low tack tape such that the high tack is affixed to the second surface of the carrier portion and the low tack tape is aligned with the compartments.

7. The method of claim 6 further comprising aligning the low tack tape so that it is aligned with the compartments and the low tack tape has sufficient thickness to prevent the components which rest on the low tack adhesive layer to come into contact with the at least one high tack adhesive layer of the high tack tape.

8. The method of claim 6 further comprising placing at least one opening into the low tack tape at a location where a component rests on the adhesive layer of the low tack tape to further reduce the adhesion of the component to the low tack adhesive layer.

* * * * *